US005150482A

United States Patent [19]

Shapiro

[11] Patent Number: 5,150,482

[45] Date of Patent: Sep. 29, 1992

[54] BATH CHAIR SWIVEL FOOT

[76] Inventor: Leo Shapiro, 5287 Ascott Bend, Boca Raton, Fla. 33496

[21] Appl. No.: 735,856

[22] Filed: Jul. 25, 1991

[51] Int. Cl.[5] ..... A47K 3/12

[52] U.S. Cl. ..... 4/562.1; 4/563.1; 4/578.1; 248/415; 248/425

[58] Field of Search ..... 4/560.1, 561.1, 562.1, 4/563.1, 564.1, 565.1, 566.1, 578.1, 579.1; 248/415, 418, 425; 297/349

[56] References Cited

U.S. PATENT DOCUMENTS

| | | | |
|---|---|---|---|
| 1,626,832 | 5/1927 | Huckel | 248/418 |
| 2,806,938 | 9/1957 | Henry | 248/415 X |
| 3,022,518 | 2/1962 | Hayden | 4/562.1 |
| 3,134,231 | 6/1964 | McCreery | 4/564.1 X |
| 3,135,550 | 6/1964 | Bosack | 297/349 X |
| 3,188,657 | 6/1965 | Cotner | 4/562.1 |
| 3,256,036 | 6/1966 | Nolan | 4/564.1 X |
| 3,280,409 | 10/1966 | Cotner | 4/563.1 |
| 3,286,970 | 11/1966 | Nolan | 4/564.1 X |
| 3,413,662 | 12/1968 | Stayton | 4/562.1 |
| 3,508,733 | 4/1970 | Skeel | 248/415 |
| 3,674,308 | 7/1972 | Radding | 297/349 X |
| 3,718,365 | 2/1973 | Gibson | 4/579 X |
| 3,825,962 | 7/1974 | Grounds et al. | 297/349 X |
| 4,628,550 | 12/1986 | Walton | 4/560.1 |
| 4,682,561 | 7/1987 | Jentry | 297/349 X |
| 4,720,140 | 1/1988 | Change, III | 297/349 X |
| 4,726,081 | 2/1988 | Duffin et al. | 4/564.1 |
| 4,945,853 | 8/1990 | Sathers | 297/349 X |
| 4,946,127 | 8/1990 | Kulaga | 248/415 X |

*Primary Examiner*—Henry J. Recla
*Assistant Examiner*—Robert M. Fetsuga
*Attorney, Agent, or Firm*—Herbert L. Lerner; Laurence A. Greenberg

[57] ABSTRACT

A bath chair has a base with a number of suction cups for rigidly attaching to the floor of a bath tub or shower stall. A stem to which a chair shell is attached is rotatably connected to the base. An improved swivel connector between the stem and the base is provided which comprises a rotator disk rigidly attached to the base. The upper surface of the disk is the supporting rotator surface. A hollow swivel cylinder is threaded into a central bore in the rotator disk and extends perpendicularly away from a surface of the rotator disk opposite the supporting rotator surface. A lid-shaped rotator shell is rigidly attached to the stem of the chair and has a rotator surface to be placed on the supporting swivel surface of the rotator disk. A cylindrical extension emanates perpendicularly from the rotator surface of the shell and fits snugly into the hollow swivel cylinder.

9 Claims, 5 Drawing Sheets

BATH CHAIR SWIVEL FOOT

BACKGROUND OF THE INVENTION

1. Field of the Invention

The invention relates to a bath chair swivel foot, and more particularly to an improvement in the base swivel connector of a tub or shower chair.

2. Description of the Related Art

Taking showers and baths is particularly difficult for motion-impaired persons such as invalids or elderly people. Numerous devices have been proposed over the years for aiding persons in the shower stall or bathtub.

U.S. Pat. No. 3,413,662 to Stayton, for instance, describes a bath seat which swivels about a pole extending between the floor and the ceiling. The user may place him or herself onto the seat outside the tub, swivel the seat inside and then lower the seat into the water. Similar devices are known from U.S. Pat. Nos. 4,628,550 to Walton and 3,022,518 to Hayden. A swivel chair is pivotally attached to an assembly which, in turn, is attached to the tub or shower wall.

U.S. Pat. Nos. 3,188,657 to Cotner and 4,726,081 to Duffin et al provide teachings for bathtub lifts, the latter including a hydraulically activated piston assembly for lifting and lowering the bath seat.

A tub chair which is commercially available in the U.S. from the firm Nolan under the name Nolan Tublift and from Blue Chip Medical, Inc. of Salt Lake City, Utah, includes a base with four suction cups for securing the chair to the tub floor, a stem section which is pivotally connected to the base, and a hydraulic lift assembly to which the seat shell is rigidly connected.

Various problems arise from the use of the above-mentioned chairs. Many are too bulky to be considered portable, i.e. for taking on trips. The attachment to tub walls is relatively complicated and usually leads to scratches in enamelled surfaces. A major problem found with the above-mentioned Nolan chair is the swivel connector between the base and the chair stem, i.e. the connection is not sturdy enough to provide the user a sufficient sense of security while sitting on the chair since, especially when the hydraulic assembly is extended, i.e. when the chair is in an upper position, the swivel connector is not able to rigidly support the chair and the weight thereon.

SUMMARY OF THE INVENTION

It is accordingly an object of the invention to provide a bath chair swivel foot, which overcomes the hereinafore-mentioned disadvantages of the heretofore-known devices of F-7043 this general type and which allows comfortable and secure placement of a person on the bath chair, largely prevents the chair stem from tilting back and forth and yet allows full swivel action. A particular object of the invention is to provide an improvement to the swivel connection used in the above-mentioned prior art Nolan and Blue Chip Medical chair.

With the foregoing and other objects in view there is provided, in accordance with the invention, a swivel foot for rotatably securing a stem of a chair to a base with a substantially vertical axis of rotation, comprising a cylindrical disk rigidly attached to the base, the disk having a supporting rotator surface facing away from the base and a central opening formed through the disk; a hollow rotator cylinder perpendicularly extending away from the disk opposite the supporting rotator surface; a lid-shaped rotator shell rigidly attached to the stem of the chair, the rotator shell having a lower rotator surface for rotating on the supporting rotator surface and an encompassing lateral extension for snugly encircling the disk when the shell is placed on the disk; a cylindrical rotator pin perpendicularly extending from the lower rotator surface for snugly frictionally rotating in the hollow rotator cylinder for ensuring snug rotational support for the chair on the base.

In accordance with an added feature of the invention, the swivel foot includes a clamping ring attached to the lateral extension for clamping the rotator disk into the rotator shell while allowing rotational movement between the shell and the disk.

In accordance with an additional feature of the invention, the hollow rotator cylinder is threaded into the central opening of the rotator disk.

In accordance with another feature of the invention, the rotator pin is threaded into and extends through a central opening formed in the rotator shell.

In accordance with a further feature of the invention, the rotator disk has an outer diameter of approximately four inches and the encompassing extensions on the rotator shell are adapted to ensure a snug rotational fit around the circumference of the rotator disk.

In accordance with a concomitant feature of the invention, the cylindrical extension is formed onto a cylindrical rod having a threaded section, the cylindrical rod being threaded into a threaded opening formed in the rotator shell and wherein the chair stem is attached to the cylindrical rod.

Other features which are considered as characteristic for the invention are set forth in the appended claims.

Although the invention is illustrated and described herein as embodied in an improved bath chair swivel foot, it is nevertheless not intended to be limited to the details shown, since various modifications and structural changes may be made therein without departing from the spirit of the invention and within the scope and range of equivalents of the claims.

The construction of the invention, however, together with additional objects and advantages thereof will be best understood from the following description of the specific embodiment when read in connection with the accompanying drawings.

DESCRIPTION OF THE PREFERRED EMBODIMENTS

Figure 1:
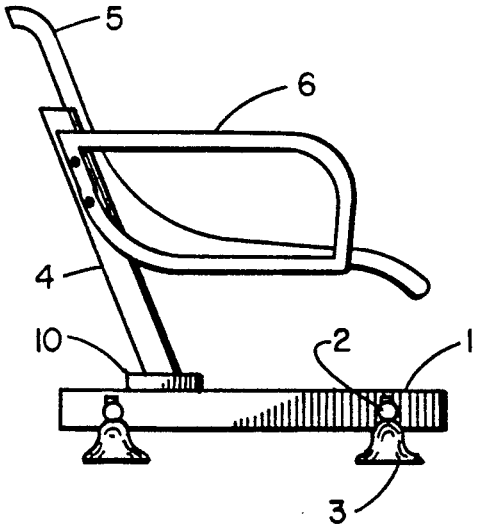
FIG. 1 is a side-elevational view of a bath tub swivel chair.

Referring now to the figures of the drawing in detail and first, particularly, to FIG. 1 thereof, there is seen a tub chair with a base 1 in the form of an elongated bar with an approximately rectangular cross section. The chair shown has four leg extensions 2 in the form of two metallic rods extending through the base 1. Four suction cups 3 are attached to the ends of the respective leg extensions 2. A spider-like construction with 3, 5 or even more legs and a corresponding number of suction cups would be equally possible and the person skilled in the art will easily adapt to specific requirements.

A swivel foot assembly 10 provides the connection between the base 1 and a stem 4. The stem 4 forms an angle with the base 1 which is somewhat other than a right angle, i.e. approximately 80 degrees. Such an oblique configuration provides excellent balancing for the chair. A chair shell 5 is attached on the stem 4 by means of a combined armrest and shell support structure 6.

All of the components described thus far must necessarily be of rust-proof and/or non-corrosive materials. Such materials include aluminum, which upon exposure to oxygen, forms a protective layer of $AlO_3$ and thus prohibits further oxidation. In fact, in the presently contemplated best mode for the preferred embodiments, all of the components are formed of aluminum, except for the suction cups 3, the seat shell 5 and some parts of the swivel foot 10.

Figure 2:
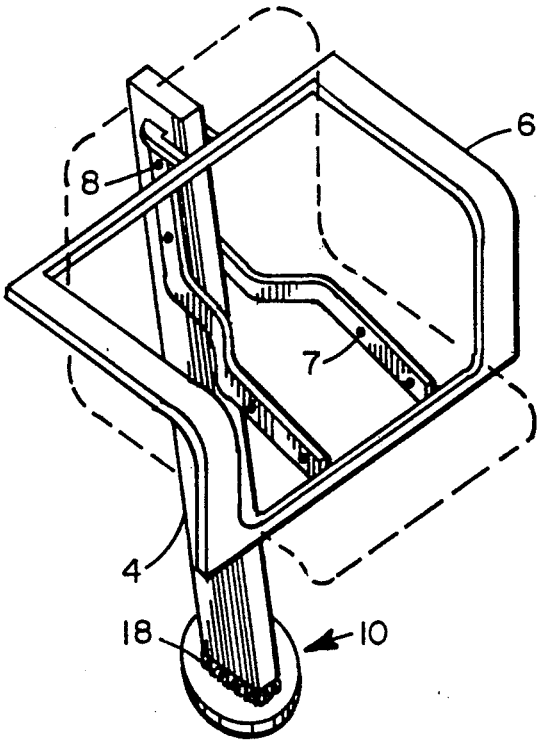
FIG. 2 is a perspective view of a combined armrest and chair shell support structure.

As shown in FIG. 2, the armrest and shell support structure 6 is provided with bores 7 for attaching the seat shell and with bores 8 for attachment to the stem 4. The stem 4 is either simply welded to the swivel foot 10, as shown by the weld seam 18, or it is attached by means of two or more bolts 11, as will be explained in the following.

Figure 3:
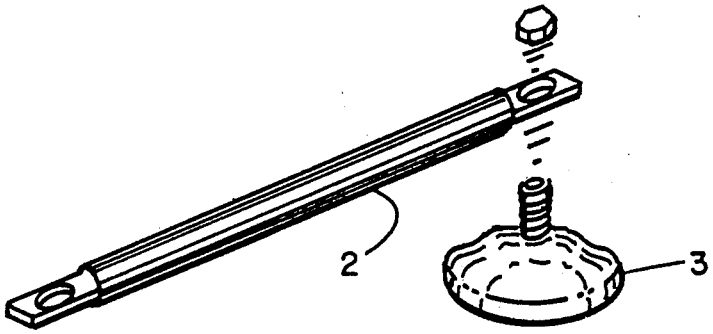
FIG. 3 is a perspective, exploded view of a leg assembly with a suction cup.

As shown in FIG. 3, the suction cups are simple rubber cups, as they are commercially available from Atlantic India Rubber Co., for example. The suction cups are bolted to the ends of the rods which make up the legs 2.

Figure 4:
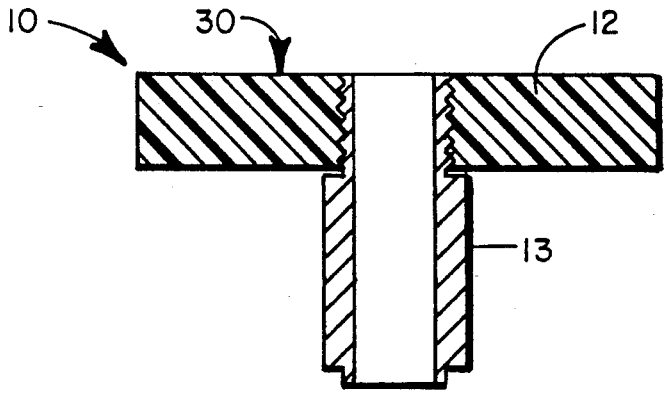
FIG. 4 is a cross-sectional view through the supporting bottom part of the swivel foot according to the invention.
Figure 5:
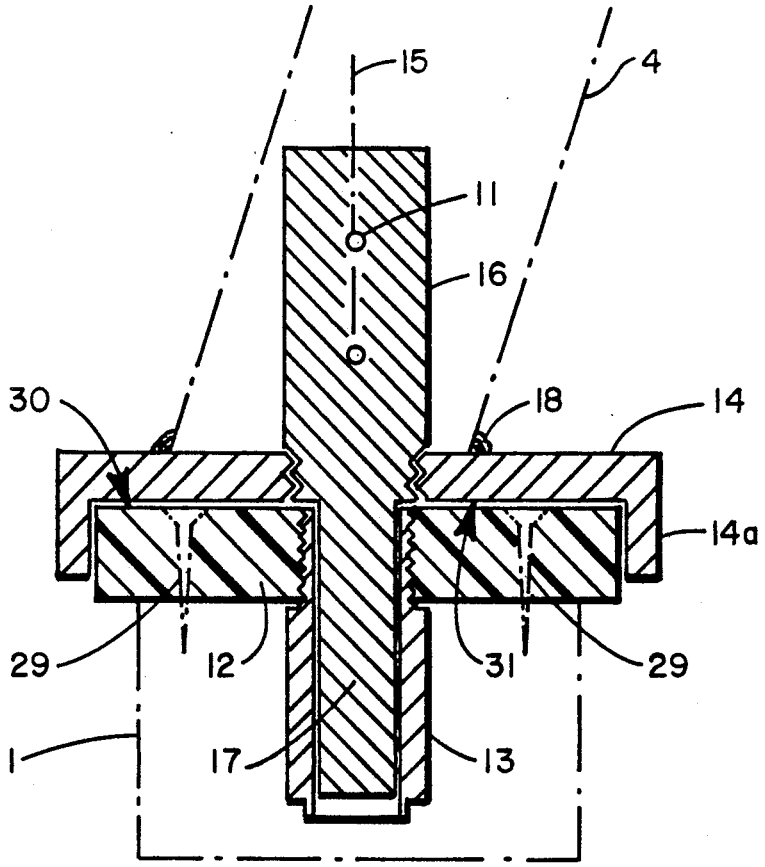
FIG. 5 is a cross-sectional view through a first embodiment of the swivel foot according to the invention.

Referring now to FIGS. 4 and 5, the bottom section of the swivel foot 10 includes a rotator disk 12 and a hollow cylinder 13, which is threaded into the rotator disk 12 in a central opening 32. The rotator disk 12, in the best mode embodiment is made of solid PVC which affords the right coefficient of friction with aluminum surfaces. The cylinder 13 is made of brass.

A rotator shell 14 is placed on top of the rotator disk 12 and remains rotatable about a vertical axis 15. The rotator shell 14 has an encompassing lateral extension 14*a* snugly surrounding the rotator disk 12. A retainer and pivot bolt 16 is threaded into the rotator shell 14 and a cylindrical rotator or pivot pin 17, which is an integral part of the bolt 16, is rotatably disposed in the cylinder 13. The inner diameter of the cylinder 13 corresponds to the outer diameter of the extension 17, so that a snug fit, yet sufficient rotatability is assured. Shown in phantom lines in FIG. 5 is the stem 4, which is rigidly attached to the bolt 16 by means of the bolts 11 and, in an advantageous embodiment, additionally directly to the rotator shell 14 by means of weld beads or weld spots 18.

Figure 6:
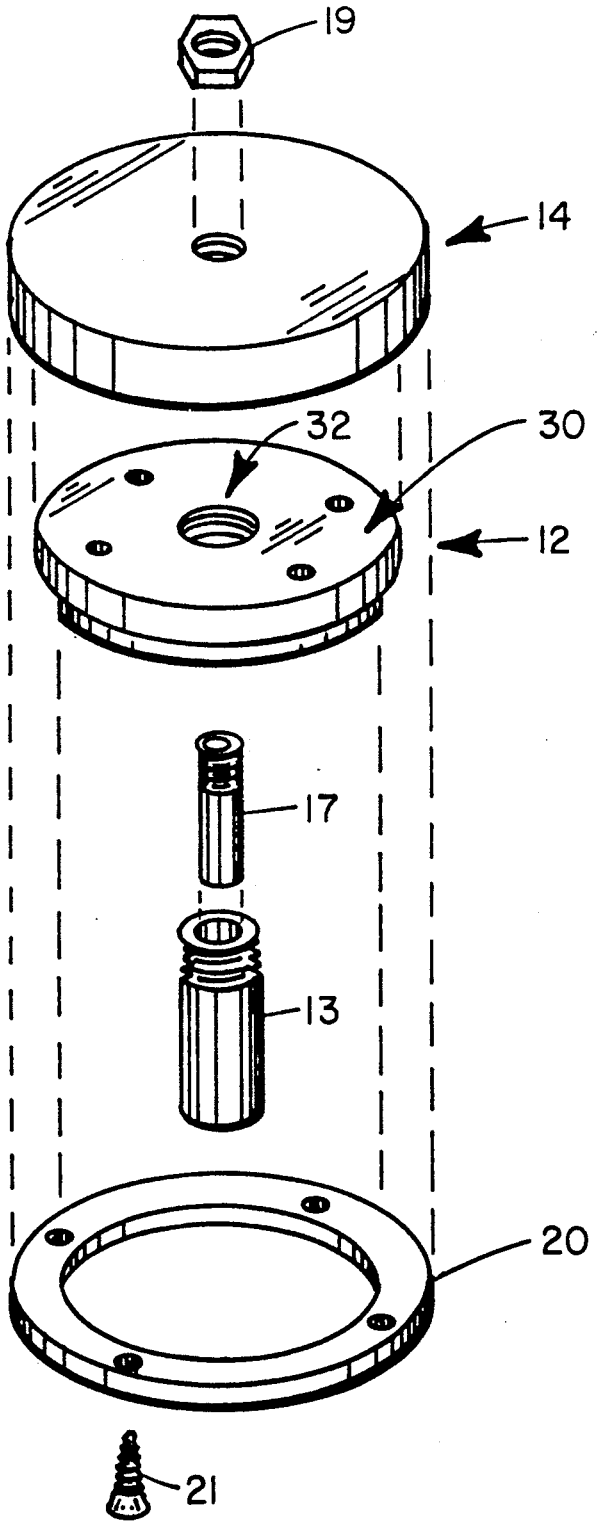
FIG. 6 is an exploded, perspective view of a second embodiment of the swivel foot according to the invention.

FIG. 6 illustrates an alternative embodiment of the swivel foot 10. The bolt 16 is not necessary but instead, the stem 4 is welded to the rotator shell 14. The rotator pin 17 is threaded into the rotator shell 14 and additionally secured by way of a nut 19. Also, to ensure a permanent connection, the nut 19 may be spot-welded to the rotator shell 14. The hollow brass cylinder 13 is threaded into the PVC rotator disk 12. A bottom ring 20 may be added to permanently connect the rotator disk 12 and the rotator shell 14.

Figure 7:
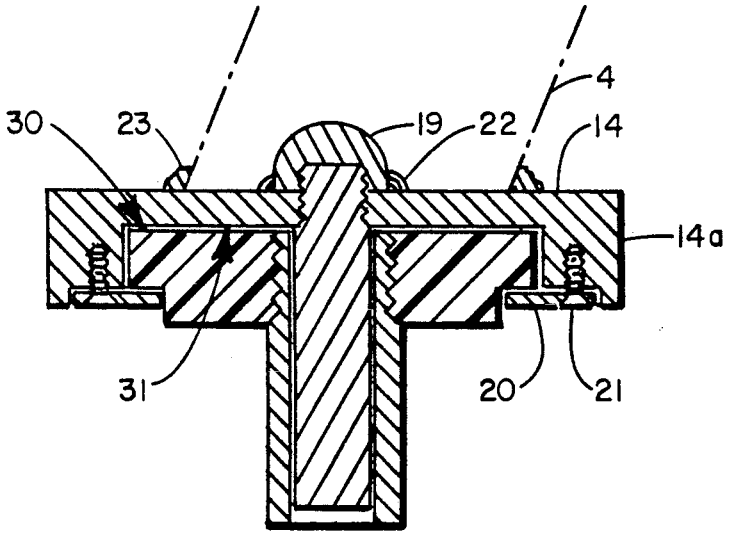
FIG. 7 is a cross-sectional view of the second embodiment of the swivel foot.

As seen in FIG. 7, the ring 20 is secured to the shell 14 by means of bolts or screws 21. In the preferred embodiment, four such bolts 21 are contemplated. Also shown in FIG. 7 are the nut 19 and weld spots 22, as well as, in phantom, the stem 4, which is welded to the rotator shell 14. A weld bead 23 encircles the stem 4 on the surface of the rotator shell 14.

Figure 8:
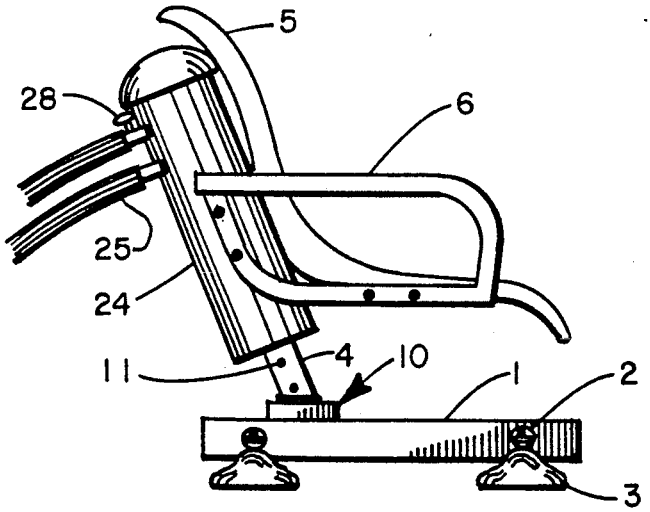
FIG. 8 is a side-elevational view of a bath swivel chair with a hydraulic lift.

The embodiment shown in FIG. 8 is largely similar to that shown in FIG. 1. A hydraulic lift assembly is added for hydraulically raising and lowering the chair. Hydraulic lifts are well known to the person skilled in the art and will thus not be described in great detail. Such a lift is commercially available, for instance, with the BCM-Tublift by Blue Chip Medical or Nolan Tublift.

Figure 9:
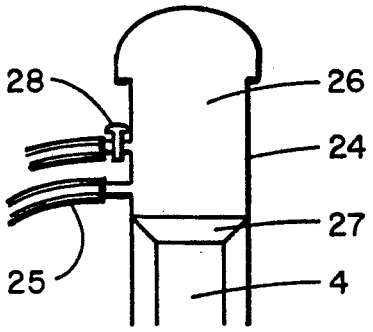
FIG. 9 is a diagrammatic cross-sectional view of a hydraulic lift.

As seen in FIG. 9, the basic principle of the lift is a water-tight cavity 26 inside a lift cylinder 24 which is subjected to pressurized water from the tap. The water enters at 25, thus filling the cavity and raising the lift cylinder 24 as the cavity 26 is being filled.

A rubber or plastic membrane 27 attached to the stem 4 ensures the water tightness of the cavity 26. When the shutoff valve 28 is opened, the water is allowed to leave the cavity 26 and thus, due to gravity, the lift chair is again lowered. Non-illustrated guides disposed within the lift cylinder 24 ensure that the lift moves smoothly on the stem 4.

Figure 10:
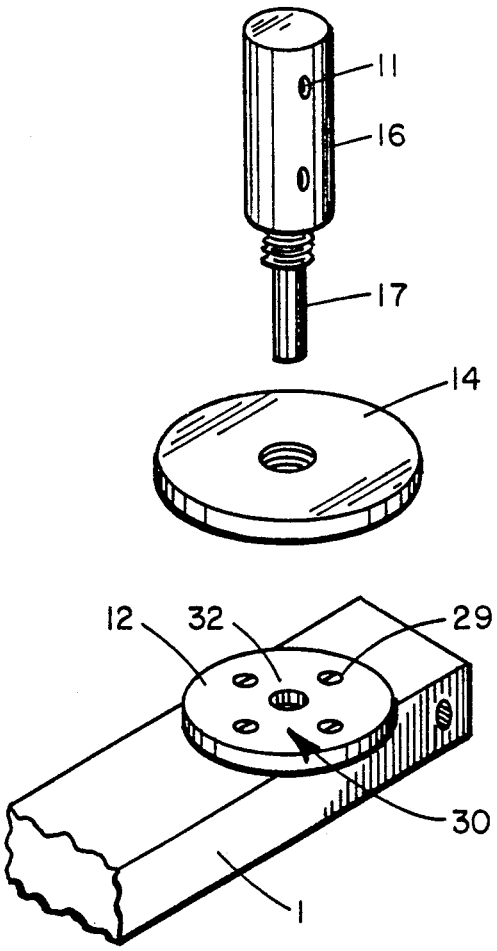
FIG. 10 is a perspective exploded view of the swivel foot.
Figure 11:
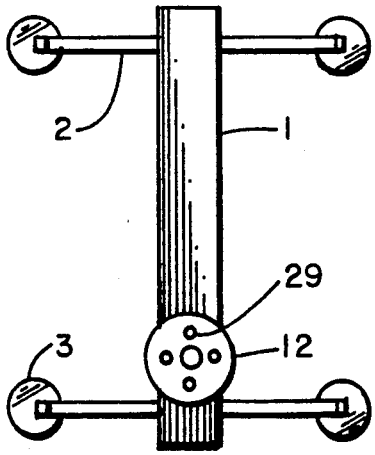
FIG. 11 is a top-plan view of a base with the support plate of the swivel foot attached.

As shown in FIGS. 10 and 11, the rotator disk 12 is attached to the base 1 by means of bolts or screws 29. In a preferred embodiment, the rotator disk has an outer diameter of approximately four inches.

The rotator disk 12 has a supporting swivel or rotator surface 30 and the lid-shaped rotator shell 14 has a lower swivel or rotator surface 31 The coefficients of friction of the two surfaces 30 and 31 relative to each other largely define the ease with which the chair may be swivelled. It has been found that a PVC disk and an aluminum shell provide very advantageous friction characteristics.

I claim:

1. In a bath chair having a base with suction cups for rigidly attaching to the floor of a bath tub or shower stall and a stem with a chair body attached thereto, the improvement comprising a swivel connector for pivotally connecting the base to the chair stem, said swivel connector including a rotator disk rigidly attached to said base, said rotator disk having an upper supporting rotator surface, a surface opposite said supporting rotator surface, and a central opening formed therethrough, a hollow swivel cylinder rigidly attached to said rotator disk in said central opening, said swivel cylinder extending perpendicularly to said supporting rotator surface and extending from said surface of said rotator disk opposite said supporting rotator surface, a lid-shaped rotator shell rigidly attached to said stem, said rotator shell having a lower rotator surface engaging on said supporting rotator surface and having an encompassing lateral extension snugly surrounding said rotator disk when said rotator shell is placed on said rotator disk, and a cylindrical rotator pin depending perpendicularly from said lower swivel surface and received in said hollow swivel cylinder for frictionally rotating in said swivel cylinder when said rotator shell is placed on said rotator disk.

2. The bath chair according to claim 1, including a reinforcement ring for pivotally clamping said rotator disk between said rotator shell and said ring while allowing said disk and said shell to rotate relative to each other.

3. The bath chair according to claim 1, wherein said rotator pin includes a cylindrical extension extending perpendicularly from said rotator shell opposite said lower rotator surface and being formed onto said cylindrical rotator pin having a threaded section, said cylindrical rotator pin being threaded into a threaded opening formed in said rotator shell and wherein the chair stem is attached to said cylindrical rod.

4. The swivel foot according to claim 1, wherein said rotator disk is formed of PVC material and said rotator shell is formed of metal.

5. A swivel foot for rotatably securing a stem of a chair to a base with a substantially vertical axis of rotation, the stem having a first end attached to the chair and a second end disposed distally from the chair, the swivel foot comprising:

a cylindrical disk adapted to the rigidly attached to the base, said disk having a support rotator surface facing away from the base and a central opening formed in said disk, said rotator disk being formed of plastic material;

a hollow rotator cylinder perpendicularly extending away from said disk opposite said supporting rotator surface, said rotator cylinder being received in said central opening;

a lid-shaped rotator shell adapted to be rigidly attached to the second end of the stem of the chair, said rotator shell having a lower rotator surface engaging said supporting rotator surface and an encompassing lateral extension snugly encircling said disk when said shell is placed on said disk, said rotator shell being formed of metal;

a cylindrical rotator pin rigidly attached to said rotator shell and perpendicularly extending from said lower rotator surface, said rotator pin being received in said hollow rotator cylinder for snugly rotating therein when said rotator shell is placed on said rotator disk.

6. The swivel foot according to claim 5, including a clamping ring attached to said lateral extension for clamping said rotator disk into said rotator shell while allowing rotational movement between said shell and said disk.

7. The swivel foot according to claim 5, wherein said hollow rotator cylinder is threaded into said central opening of said rotator disk.

8. The swivel foot according to claim 5, wherein said rotator pin is threaded into and extends through a central opening formed in said rotator shell.

9. The swivel foot according to claim 5, wherein said rotator disk has an outer diameter of approximately four inches.

* * * * *